US006631887B1

(12) United States Patent
Walmsley

(10) Patent No.: US 6,631,887 B1
(45) Date of Patent: Oct. 14, 2003

(54) VERTICAL FENCING

(76) Inventor: Roger Walmsley, Mercian House, 15 Gleneagles, Amington, Tamworth (GB), B77 4NS ( * ) Notice: Subject to any disclaimer, the term of this patent is extended or adjusted under 35 U.S.C. 154(b) by 0 days.

(21) Appl. No.: 09/855,212

(22) Filed: May 14, 2001

(51) Int. Cl.[7] ..... E04H 17/16
(52) U.S. Cl. ..... 256/22; 256/65.01
(58) Field of Search ..... 256/21, 22, 24, 256/59, 34, 65.01–65.12, 66, 68, 70

(56) References Cited

U.S. PATENT DOCUMENTS

| | | | | | |
|---|---|---|---|---|---|
| 2,218,953 A | | 10/1940 | Gustafson | 256/22 |
| 3,067,985 A | | 12/1962 | Cusack | 256/22 |
| 3,960,367 A | * | 6/1976 | Rogers | 248/230.9 |
| 4,208,038 A | * | 6/1980 | Reid | 256/21 |
| 5,150,885 A | | 9/1992 | Leone | 256/22 |
| 5,372,354 A | * | 12/1994 | Cacicedo | 256/22 |
| 5,443,244 A | * | 8/1995 | Gibbs | 256/22 |
| 5,547,169 A | * | 8/1996 | Russell | 256/59 |
| 5,581,868 A | | 12/1996 | Bisch | 29/525.08 |
| 5,873,564 A | | 2/1999 | Bisch | 256/65 |
| 6,053,480 A | * | 4/2000 | De Guise | 256/22 |

FOREIGN PATENT DOCUMENTS

DE 86 02 840 U 6/1986

OTHER PUBLICATIONS

European Search Report, Issued Apr. 8, 2003 in related case.

* cited by examiner

*Primary Examiner*—Robert E. Pezzuto
(74) *Attorney, Agent, or Firm*—Pedersen & Co. PLLC; Ken J. Pedersen; Barbara S. Pedersen

(57) ABSTRACT

In self-adjusting vertical tube fencing, a rail and a method of assembling the fencing are provided. The rail comprises an elongated channel with a top wall and two side walls, each of the side walls being of substantial U-section with an outer part connected to the top wall and an inner inturned part, the top wall having a series of apertures through which respective tubular fence members are fitted. The inturned parts have a notch which can accommodate a fixed peg carried by a fence member. The inturned parts also have an extension adjacent the notch, the extension being provided to permit rotation of the fence member about its longitudinal axis during assembly so that the peg can engage the notch.

6 Claims, 4 Drawing Sheets

VERTICAL FENCING

FIELD OF THE INVENTION

This invention relates to vertical fencing, and in particular to vertical tube fencing.

BACKGROUND TO THE INVENTION

Vertical fencing has been known for a number of years. This fencing comprises (in use) a plurality of vertical fence members which are supported by two substantially horizontal rails, a rail being located adjacent the top and bottom of the fence members. The fencing is adapted as security fencing to prevent access by unauthorised persons, and so the fence members are sufficiently closely spaced to prevent such access. Typically the fence members are of a length to prevent or reduce the likelihood that the fence can be climbed, and the rails are positioned sufficiently far apart to impair their use as a climbing aid for a person wishing to climb over the fence. In addition, the fence members project beyond the top rail, and their free ends can carry spikes or other features (which may be partly decorative), which spikes or features act to dissuade a person from climbing over the fence.

Vertical fencing is typically manufactured in sections, each section comprising a number of fence members and two rails. The sections are manufactured off-site and are then transported to the fence site. The rails are adapted to be connected to posts which are erected on the fence site at spaced positions along the line of the fence, two adjacent posts supporting either end of the rails of each section.

If the fence is at a site at which the ground is flat and horizontal the fence members can be permanently secured to the rails (as by welding), and can be exactly perpendicular to the rails, so that in the assembled fence the rails are horizontal and the fence members are vertical. However, it is often the case that the ground at the fence site is not flat and/or horizontal, so that if permanently secured fence members are used it is necessary to "step" the fence, i.e. to have one section higher or lower than an adjacent section to follow the slope of the ground. Such stepping is often visually unacceptable to the fence builder or architect. In addition, such stepping produces difficulties in fitment of the sections to the posts; thus, often the fitting means for the rails are pre-secured to the post(s), and it is difficult or impossible accurately to pre-secure the fitting means if the positions of these vary according to the slope of the ground adjacent the erected post location.

To overcome these difficulties, it is desired that the fence follow the contours of the ground, i.e. whilst the fence members remain vertical the rails can be pivotted relative thereto so that the rails are no longer perpendicular to the fence members but can be substantially parallel to the (non-horizontal) ground. A fence section in which the fence members can pivot relative to the rails is referred to as "self-adjusting". Typically, up to 20° of pivotting movement can be accommodated by self-adjusting vertical fencing.

DESCRIPTION OF THE PRIOR ART

Self-adjusting vertical fencing systems have been known for many years. One such system is known in the trade as "Nibal", and in this system the fence members are fitted to the rails by way of apertures in the rails; the fence members are then crimped (or "ribbed") adjacent the apertures so that subsequent removal from the rail is prevented. However, the crimping allows sufficient flexibilty in the joint between the fence members and the rails so that self-adjustment is possible. The "Nibal" system is shown in the 1930 catalogue of Baylis, Jones & Baylis, a well-known U.K. fencing manufacturer.

As described, the "Nibal" system relies upon the fence members being crimped. Traditionally, the fence members were of substantially circular cross-section solid steel bar 16 mm in diameter (or thereabouts). The substantial bar thickness was required to prevent adjacent bars being bent and separated, which could permit access through the fence. A fencing section would comprise two rails and perhaps twenty bars, and clearly such fencing sections were extremely heavy and so difficult and expensive to transport from the manufacturing location to the fence site.

Nowadays, it has become customary to use tubes as the fencing members rather than solid bars, the tubes being of a diameter and wall thickness sufficient to prevent or reduce the likelihood of bending and yet offering a substantial decrease in weight over an equivalent strength bar. Thus, "vertical bar fencing" has been largely replaced by "vertical tube fencing".

However, it has not been found possible reliably to crimp the tubes used for vertical tube fencing, so that the "Nibal" system is not practical for self-adjusting vertical tube fencing.

Notwithstanding that the "Nibal" system is not practical for vertical tube fencing, architects, customers, and the like are still demanding self-adjustment, so that there is a requirement for an alternative to the "Nibal" system which is suitable for vertical tube fencing.

DISCLOSURE OF THE INVENTION

The present invention therefore seeks to provide vertical tube fencing which is self-adjusting.

According to the invention, there is provided vertical fencing comprising a pair of rails and a plurality of fence members attached thereto, the fence members being pivotable relative to the rails, characterised in that the fence members are tubular, and in that each fence member carries a resiliently-biassed projection which is engageable with recess means in one of the rails.

Preferably, when the projection is engaged in the recess means movement of the fence member parallel to its longitudinal axis is limited. Accordingly, unauthorised removal of the fence member from the rail or rails is prevented.

Preferably also, when the projection is engaged in the recess means rotational movement of the fence member about its longitudinal axis is limited. Accordingly, if the fence members have asymmetric features fitted thereto (as for example may be provided by decorative end fittings), those features will be maintained in alignment along the fence.

Desirably, the projection should be a sufficiently tight fit within the recess so that longitudinal movement and rotation is substantially prevented, so that the possibility of rattling of the fence member relative to the rails is prevented or reduced.

Desirably, at least one of the rails comprises a channel section, the recess being provided by a notch or hole in an inturned part of the section. Accordingly, the recess can be substantially invisible when the fence section has been assembled, so that subsequent unauthorised removal of the projection from the recess is substantially or totally prevented.

Preferably, the resiliently-biassed projection is provided by a spring clip; preferably also the body of the clip is located within the fence member.

Desirably, only one of the rails has a recess for engagement by a projection. In such an embodiment, the other rail can be attached to the fence member by a pair of fixed pegs or the like. It will be understood that the retention and anti-rotation aspects of the projection and recess need only be provided on one of the rails, since removal of the fence member from, or rotation of the fence member relative to, the other rail is limited by said one of the rails.

Desirably, the fence member has a pair of resiliently-biassed projections, usefully projecting in opposed directions for engagement in opposed recesses.

Usefully, in the assembled condition the projection is substantially perpendicular to the plane of the fence section, so that the projection and recess can additionally provide the pivot point between the rail and fence member.

BRIEF DESCRIPTION OF THE DRAWINGS

The invention will now be described, by way of example, with reference to the accompanying drawings, in which.

DESCRIPTION OF THE EXEMPLARY EMBODIMENTS

In the following description, directional and orientational terms such as "top", "bottom" etc. refer to the orientation of the components as drawn, which will typically also be the orientation of use.

Figure 1:
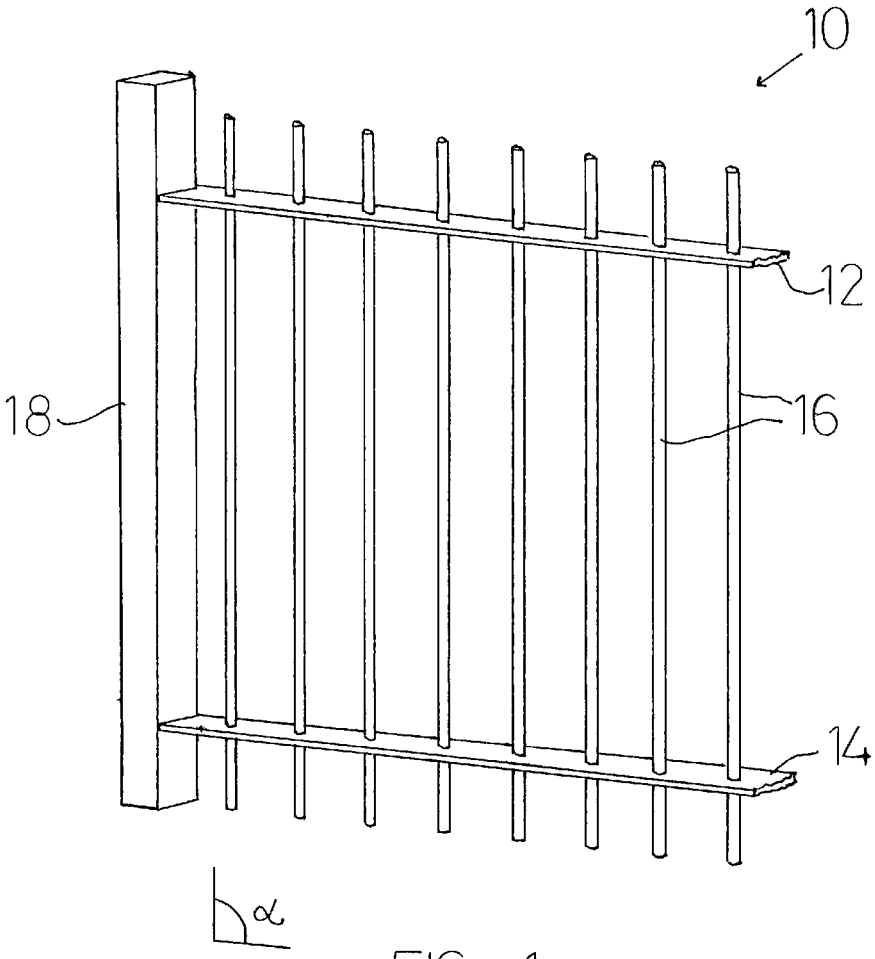
FIG. 1 is a perspective view of part of a (non-self-adjusting) fence section secured to a post.

The vertical fence section 10 (part of which is shown in FIG. 1) comprises two rails 12,14 to which a number of fence members 16 are attached. The rails 12,14 are both connected to a post 18 in known fashion. In this embodiment, the fence is non-self-adjusting, so that the angular (in this embodiment perpendicular) relationship between the fence members 16 and the rails 12,14 is fixed. The fence members 16 in this embodiment are welded to the rails 12,14.

Typically, an assembed fence will comprise a number of fence sections 10, each fence section being connected to posts 18 by way of the ends of the rails 12,14. The posts 18 define the line of the fence and are erected on the site. The fence sections 10 are generally pre-assembled i.e. manufactured off-site and supplied to the site ready for connection to the posts. A fence section 10 can for example have between ten and twenty fence members 16, spaced so as to prevent the access of a person therebetween.

As above described, to permit the fence to follow the contours of the ground, it is desirable that the rails can pivot relative to the fence members, i.e. the angle a can vary from 90° as in the embodiment of FIG. 1 (this angle does not appear as 90° in the drawing because of the perspective), perhaps varying by as much as 20° on particularly sloping ground.

Figure 2:
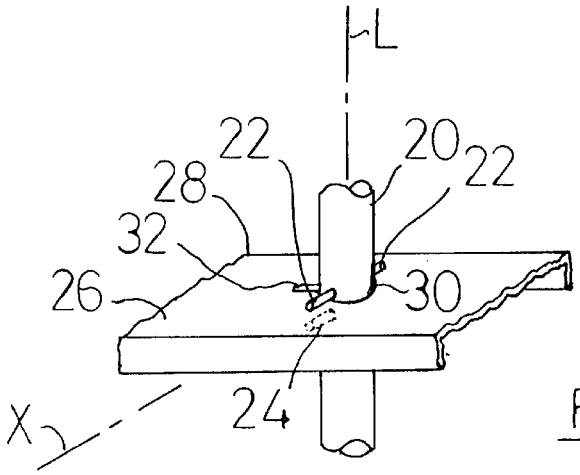
FIG. 2 is a perspective view showing an attachment of a fence member to a rail.

A pivotable or adjustable attachment of a fence member to a rail is as shown in FIG. 2. The fence member 20 has three fixed pegs, two of which pegs 22 are oppositely directed and lie in substantially the same plane along the longitudinal axis of the fence member 20. The third peg 24 lies in a plane which is spaced from the plane of the pegs 22 by a distance slightly greater than the thickness of the wall 26 of the rail 28. Thus, in the assembled condition as shown the pegs 22 lie above the wall 26, whilst the peg 24 lies below the wall 26. The pegs 22 therefore prevent the fence member 20 from being moved downwards relative to the rail 28, whilst the peg 24 prevents the fence member 20 from being moved upwards relative to the rail 28.

In order to attach the fence member 20 to the rail 28, the rail has an aperture 30 which is generally an elongated circle but has a key-slot 32, the key-slot being sized to accommodate the peg 24. When attaching the frame member 20 to the rail 28 the frame member is pushed from above into the aperture 30 and oriented so that the peg 24 can pass through the key-slot 32. When peg 24 has been passed through key-slot 32 the frame member 20 is rotated through 90° about its longitudinal axis L to the position shown in FIG. 2.

In other embodiments, there can be two key-slots sized and positioned to accommodate the pegs 22, and the frame member is attached to the rail "from below", i.e. the pegs 22 are passed through the respective key slots before the rail is rotated. In yet other embodiments, the arrangement of the pegs is reversed, i.e. the two substantially co-planar pegs lie below the single peg.

In FIG. 2, the peg 24 is parallel with one of the pegs 22; whilst this is a desirable feature since it allows ease of pivotting movement (i.e. all of the pegs can be parallel with the pivot axis X), in other embodiments strict alignment is not necessary.

In the assembled condition as shown in FIG. 2, the frame member 20 can pivot about the axis X relative to the rail 28 (the elongated aperture 30 and the orientation of the pegs 22,24 facilitating such pivotting); such an attachment can therefore be used for self-adjusting vertical fencing.

It will be understood that in other embodiments two pegs offset by a distance slightly greater than the thickness of the wall 26 could be provided. The pegs could be aligned or oppositely directed, as desired. In yet other embodiments in which the peg(s) were not required to prevent longitudinal movement in both directions, a single peg could be provided; in such embodiments a key-slot may not be necessary. In further embodiments in which the resistance to longitudinal movement of the frame member was solely provided at the other rail, the frame member could be "loose" relative to one rail, i.e. merely passing through an aperture to prevent lateral frame member movement; however, such further embodiments are not preferred since in practice it may be possible to force the rails apart, and so some means of limiting relative movement of the frame member and rail is desired for both rails.

It will also be understood that whilst the attachment of FIG. 2 limits movement of the frame member 20 relative to the rail 28 along the longitudinal axis L of the frame member, it does not limit rotation of the frame member 20 about the axis L. Accordingly, whilst such an attachment is suitable for attaching the fence member 20 to one of the rails 28, another form of attachment is desirable for the other of the rails.

Figure 3:
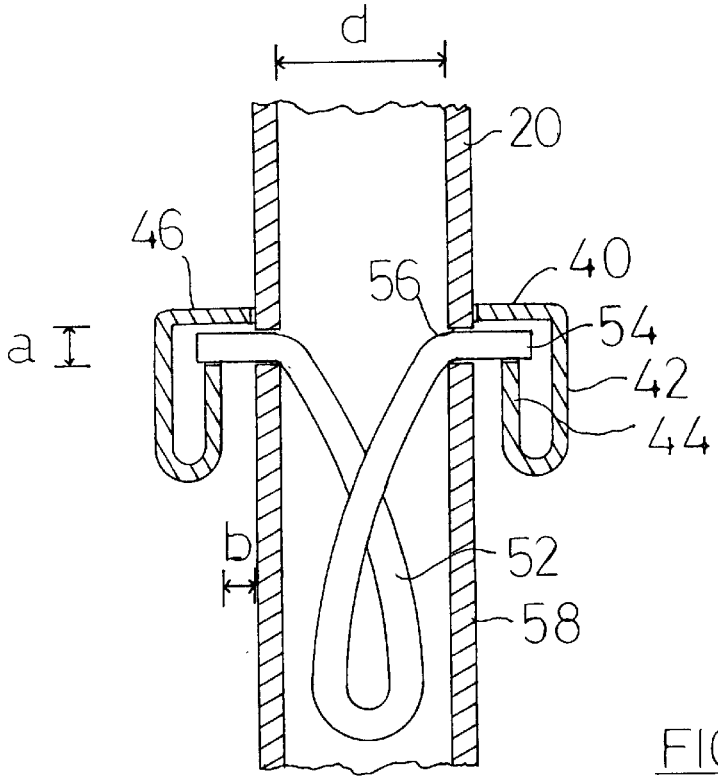
FIG. 3 is a sectional view of an attachment of a fence member to a rail of a vertical fence according to the invention.

An attachment which can limit movement along the longitudinal axis L and also limit rotation thereabout is shown in FIG. 3. The rail 40 is of channel section and its side walls 42 each have an inturned part 44, the inturned part 44 terminating adjacent the wall 46 and having a recess in the form of a notch 50 (see also FIG. 4) in the inturned part 44. In the embodiment shown, both inturned parts 44 have a notch 50, and these notches 50 are aligned.

The frame member 20 carries a spring clip 52, the ends 54 of which can project through opposed openings 56 in the wall 58 of the tubular frame member. In this embodiment the spring clip 52 is of stainless steel with a circular cross-section having an outer diameter of approximately 4 mm; the action of the clip is resiliently to bias the ends 54 of the clip out of the openings 56, i.e. a force is required to push the ends 54 into the frame member 20.

In other embodiments the clip is of carbon steel or any other suitable material, perhaps even a plastics material, having the desired resilience and strength.

Figure 5:
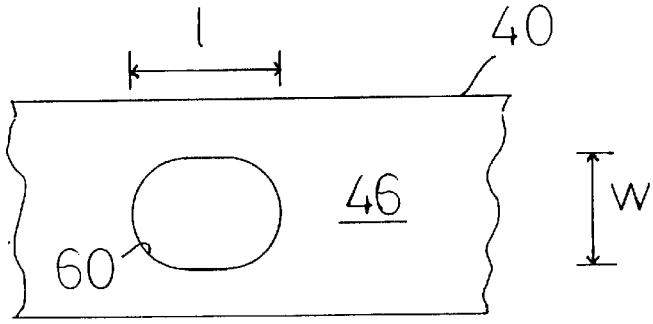
FIG. 5 is a plan view of part of the rail of FIG. 3.

As seen in FIG. 5, the wall 46 of the rail 40 has an elongated aperture 60, the elongation being required to permit the required amount of relative pivoting of the frame member 20 thereto.

To assemble the frame member 20 to the rail 40, the spring clip 52 is first inserted into the end of the tubular frame member 20 by a suitable tool. The tool can either maintain the clip in its stressed condition (i.e. with the ends 54 held closer together than the inner diameter d of the tubular frame member 20), or alternatively (and more simply), the clip can be located adjacent the openings 56 but not aligned therewith, so that the clip is maintained in its stressed condition by the wall 58. The frame member 20 is moved into position relative to the rail 40, which will usually include the positioning of the attachment for the other rail. When correctly positioned, with the openings 56 substantially aligned with the notches 50, the clip 52 is moved within the frame member 20 so that its ends 54 are aligned with the openings 56 and the ends 54 are caused by the resilience of the clip 52 to project therefrom into the respective notches 50. In the event that the openings 56 are not perfectly aligned with the notches 50, the ends 54 of the clip 52 may undergo two-stage movement, i.e. projecting from the openings 56 until they engage the inturned parts 44, whereupon the frame member 20 will require to be moved until the ends 54 of the clip 52 can spring into the respective notches 50.

In an alternative method of assembly, the clip 52 is fitted to the frame member 20 so that its ends 54 project from the openings 56. The frame member 20 is then inserted into the aperture 60 with the ends 54 of the clip projecting substantially perpendicular to the line of the notches 50. When the frame member 20 has been correctly positioned it is rotated through approximately 90°, which rotation causes the ends 54 of the clip 52 to ride along the respective inturned parts 44 of the rail 40, partially pushing each end 54 back through its respective opening 56 until the ends 54 are aligned with the respective notches 50 and they spring out into the notches.

It is expected that certain embodiments will utilise an attachment of FIG. 2 for one of the rails of a fence section and an attachment of FIG. 3 for the other rail, and it will be understood that the 90° rotation described above matches the rotation required for the attachment of FIG. 2.

It is arranged that in the assembled condition shown in FIG. 3, the difference between {i} the dimension "a", i.e. the "depth" of the notch 50 between its bottom edge and the underside of the wall 46 of the rail 40, and {ii} the diameter of the end 54 of the clip 52, is as small as possible, perhaps 1 mm or even less. This difference determines the maximum amount of movement of the fence member along its longitudinal axis L, and as previously described this should be as small as possible to reduce the possibility that the fence member can be rattled.

It is also arranged that the lateral dimension of the notch only slightly exceeds the corresponding diameter of the end 54 of the clip 52, so that rotation of the frame member 20 about its longitudinal axis is substantially prevented by engagement of the ends 54 of the clip 52 with the sides of the notches 50.

Clearly, the spring clip could be other than of circular cross-section, and if so references herein to "diameter" should be amended accordingly.

The notches 50 provide three functions, namely {i} the limitation of longitudinal movement of the frame member, and {ii} the limitation of rotational movement of the frame member (as both discussed above), and {iii} a bearing surface upon which the end 54 of the clip 52 can pivot when the fence is undergoing adjustment.

Whilst the embodiment shown has two notches, in other (albeit less preferred) embodiments only a single notch is provided, and in such embodiments the frame member would likely have only a single opening 56.

It will be understood that a frame member 20 which is attached to one rail of a fence section by an attachment of FIG. 2 can nevertheless be prevented from rotating relative to the rail 28 by its attachment (as in FIG. 3) to the other rail.

It will also be understood however, that the frame member could be "loose" relative to one of the rails, i.e. merely passing through an aperture therein to provide lateral stability, the attachment to the other rail providing the limits on longitudinal and rotational movement of the frame member. At the other extreme would be the use of the attachment of FIG. 3 to both rails of a fence section.

It has been determined that for a frame member 20 comprising a tube of 25 mm outer diameter, an aperture 60 of a width w of 26 mm and a length 1 of 30 mm, will provide up to approximately 20° of pivotting movement, for a rail formed of 2 mm thick channel section.

It will be understood that the dimension "b" of FIG. 3 can be as small as desired, i.e. the distance between the inturned parts 44 of the side walls 42 need be only slightly greater than the thickness of the fence member; accordingly, access for a person's fingers (or more likely a tool) to force the end 54 of the clip 52 out of the notch 50 could be substantially prevented. Even with a relatively large dimension "b", visual inspection of the attachment is difficult to obtain on an assembled fence, so that a person intent on removing one or more fence members will be significantly encumbered.

Figure 6:
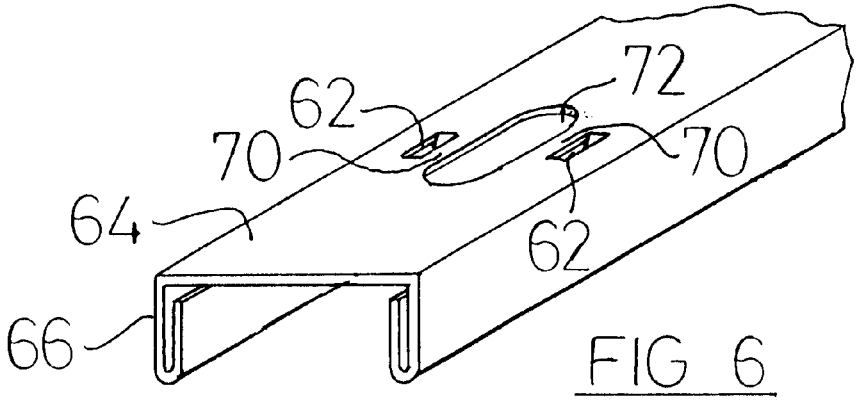
FIG. 6 is a perspective view of part of a rail of a vertical fence according to another embodiment of the invention.
Figure 7:
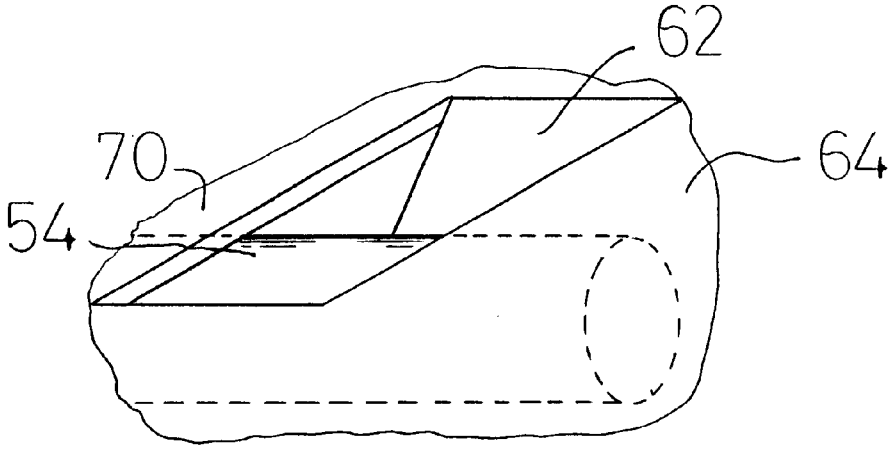
FIG. 7 is an enlarged perspective view of part of the attachment of FIG. 6.
Figure 8:
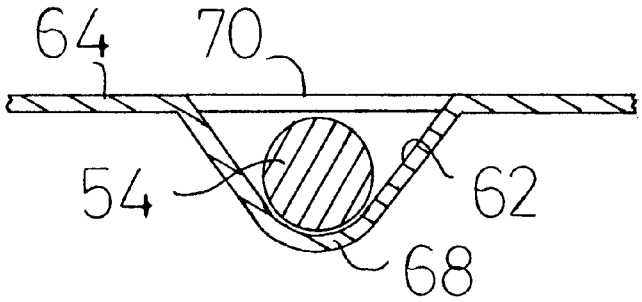
FIG. 8 is a sectional side view of the attachment of FIG. 6.

In the alternative embodiment of FIGS. 6–8, the recess means is created by a pair of depressions 62 pressed into the wall 64 of the rail 66, the depressions 62 each being deep enough to permit the end 54 of a spring clip 52 to lie therewithin. Accordingly, the bottom 68 of each depression 62 limits longitudinal movement of the fence member (not shown in FIGS. 6–8) in a first direction (towards the bottom of the page as drawn), whilst the part 70 of the wall 64 of the rail remaining between the depressions 62 and the aperture 72 limits longitudinal movement of the fence member in the opposed direction. The depressions 62 as shown are preferably sized to significantly limit the sideways movement (as drawn in FIG. 8) of the ends 54 of the clip 52, so that rotation of the fence member relative to the rail is substantially prevented.

It will be seen from FIG. 7 that the end 54 of the spring clip 52 projects through the depression and terminates beyond the depression. This is preferred since in those alternative embodiments in which the end 54 terminates within the depression it might be possible to insert a tool to drive the end 54 back out of the depression.

In an alternative embodiment the depressions can lie immediately adjacent the rail aperture, the end or ends of the spring clip projecting through the depression so that a part of the end lies below a part of the wall of the rail; accordingly, the section of the wall which limits longitudinal movement of the frame member in said opposed direction does not need to lie between the rail aperture and the depression.

Figure 9:
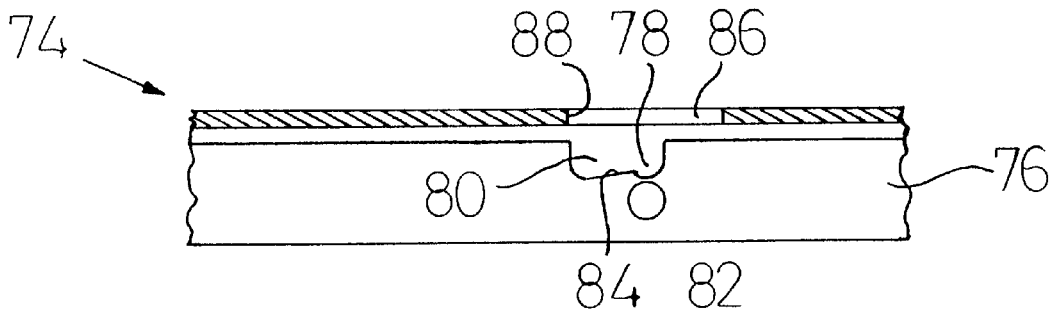
FIG. 9 is a sectional view of an alternative design of rail for use with a vertical fence according to the invention; nd

FIG. 9 shows an alternative design of rail 74. The rail 74 is of channel section with inturned parts 76 (only one of which can be seen in this mid-sectional view), and is therefore of similar form to the rail 40 of FIGS. 3–5).

Each inturned part 76 has a notch 78, which notch is connected to an extension 80. Each inturned part 76 also has a hole 82 formed therein, which lies adjacent the notch 78.

The form of the rail 74 is chosen so that one design of rail can be used at the top and bottom of the vertical fencing, notwithstanding that a spring clip such as that shown in FIG. 3 only engages one of the rails (usually the bottom rail in use). The ability to use a single design of rail reduces the tooling and inventory costs of the fencing manufacturer, and also reduces the likelihood of incorrect manufacture.

With rails as shown in FIG. 9, each fence member (not shown in this figure) carries a spring clip (which may be similar or identical to the clip 52 shown in FIG. 3) which is engageable with the aligned holes 82 in the respective inturned parts 76. The fence member also carries two fixed pegs (perhaps similar to the pegs 22 of the fence member of FIG. 2) which are engageable with the aligned notches 78 in the respective inturned parts 76. The purpose of the extension 80 is to allow the fence member to be positioned in the correct longitudinal position relative to the rail 74 and then rotated so that the pegs enter the extension 80, ride up the ramp 84, and then locate within the notch 78. It is arranged that when the fixed pegs have entered the notch 78 in one rail 74, the ends 54 of the spring clip 52 can enter the respective holes 82 in the other rail 74.

When so assembled, the fence member is retained against rotation and longitudinal and lateral movement by the engagement of the ends 54 of the spring clip 52 in one rail 74, and by the location of the fixed pegs in the notches 78 of the other rail 74 (the wall 86 of the rail 74 preventing upwards (as drawn) movement of the fixed pegs).

It will be understood that the hole 82 should be as close to the wall 86 as possible, so that the elongated aperture 88 in the wall 86 can be elongated to the minimum amount necessary for the degree of pivoting required for the fence member. With the design of FIG. 9 the hole 82 is necessarily spaced from the wall 86 by a distance greater then the depth of the notch 78, and so the elongation of the aperture 88 will be greater than that necessary in the embodiment of FIGS. 3–5; nevertheless this will in many cases be an acceptable penalty in view of the saving in tooling and inventory afforded by a common design for both rails.

Alternatively, it might be desirable to have a different form of top rail and bottom rail, notwithstanding the likely penalty in increased tooling costs and inventory. In such embodiments, it would not be necessary that both rails have a hole for the spring clip and a notch for the fixed peg, but only one or the other of these (e.g. the top rail could have the hole for spring clip and the bottom rail could have the notch for the fixed peg). Accordingly, the hole(s) for the spring clip could be closer to the wall (86) of the rail in which this was present, reducing the length of the elongated aperture in the wall needed for the degree of pivoting desired.

It will be understood that the extension in the other inturned part 76 (the inturned part not seen in FIG. 9) extends in the other direction to the extension 80, to permit rotation of the fixed pegs as above indicated. In an alternative but less desired embodiment, an extension 80 is provided to each side of the notch 78, to permit entry of the fixed peg from both sides.

Figure 4:
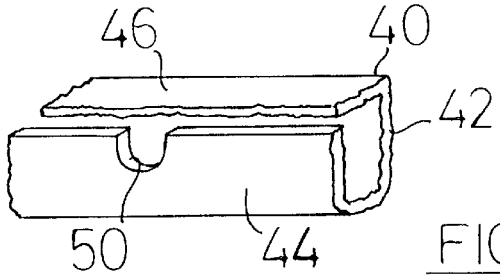
FIG. 4 is a perspective view of part of a rail of FIG. 3.

The provision of a hole 82 of predetermined size in the inturned part has an additional advantage over the notch 50 of FIGS. 3–5, since the hole could overcome a possible concern which arises as a result of manufacturing tolerances. Thus, the dimension "a" of FIG. 3 could vary due to manufacturing tolerances to an undesirable degree, with a consequent undesirable variation in the longitudinal freedom of movement of the end 54 of the spring clip 52 in that embodiment.

Figure 10:
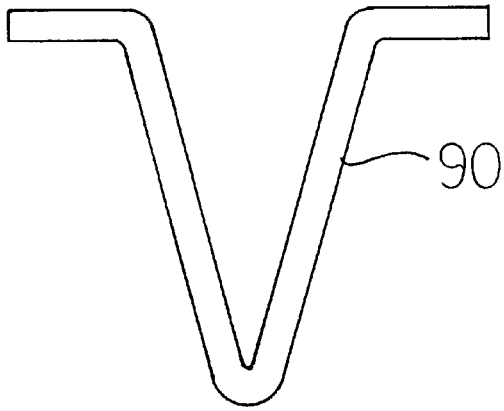
FIG. 10 is a view of an alternative design of spring clip.

FIG. 10 shows an alternative design of spring clip 90 which can be used in place of the spring clip 52 of FIG. 3. The spring clip 90 can if desired be used in the embodiment of FIG. 3–5, or FIG. 9.

The notches 50 and the holes 82 provide three functions, namely {i} the limitation of longitudinal movement of the fence member, {ii} the limitation of rotational movement of the fence member (as both discussed above), and {iii} a bearing surface upon which the ends 54 of the clip 52 (or the corresponding ends of the spring clip 90) can pivot when the fence is undergoing adjustment.

It will be understood that several alternative forms and locations of recess have been included herein but it is not expected that the list of alternatives is all-inclusive, i.e. it is expected that alternative means of formation of the recess or recesses could be provided by one skilled in the art, but nevertheless such alternatives would fall within the scope of the invention.

It has been recognised that the fence members 20 can be fitted to the rails 28,40,74 after painting of the fence members and rails, i.e. because no welding or other heat treatment is required to attach the fence members to the rails, any pre-applied paint will not be damaged. Accordingly, it is possible with vertical fencing according to the invention to have differently coloured fence members (perhaps alternately coloured) in the or each fence section, increasing the architect's or designer's freedom of choice in the aesthetic appeal of the fence.

In addition, it is possible to fit the fence members to the rails "on-site", or more practicably at a site located away from the manufacturing location. This latter advantage provides significant benefit for reducing transportation costs, since the frame members and rails can be supplied separately, and perhaps even exported, for local assembly, so avoiding the transportation of much wasted space which is common with pre-assembled fence sections.

The material from which the rails are manufactured would typically be a metal. Steel is a suitable material, as is alumimium, though other materials are likely to be suitable also.

What is claimed is:

1. A rail for use in self-adjusting vertical tube fencing, comprising an elongated channel with a top wall and two side walls, each of the side walls being of substantial U-section with an outer part connected to the top wall and an inner inturned part, the top wall having an aperture through which a tubular fence member may be fitted, the inturned parts each having a notch which can accommodate a fixed peg carried by the fence member, the fence member having a longitudinal axis, the inturned parts also having an extension adjacent the notch, the extension being provided to permit rotation of the fence member about its longitudinal axis during assembly so that the peg can engage the notch.

2. A rail according to claim 1 in which there are two extensions in each inturned part, one extension to each side of the notch.

3. A rail according to claim 1 in which the extension includes an inclined ramp.

4. A rail according to claim 1 including a hole adjacent the notch.

5. A method of assembling self-adjusting vertical tube fencing having a rail and at least one fence member, the fence member being tubular, having a longitudinal axis, and with a pair of oppositely-directed fixed pegs projecting therefrom, the rail comprising:

an elongated channel with a top wall and two side walls, each of the side walls being substantial U-section with an outer part connected to the top wall and an inner inturned part, the top wall having an aperture through which a tubular fence member may be fitted, the inturned parts each having a notch which can accommodate a fixed peg of the fence member, the inturned parts also having an extension adjacent the notch, the method comprising the steps of:

(i) locating the tubular fence member within the aperture so that the fixed pegs lie alongside the respective inturned parts, and (ii) rotating the fence member about its longitudinal axis so that each peg enters the extension and subsequently the notch in the respective inturned part.

6. A method of assembling a section of self-adjusting vertical tube fencing comprising two rails and a number of tubular fence members, including the steps of:

(i) preparing the tubular fence members, each with at least one fixed peg projecting therefrom, (ii) preparing a rail with an aperture to receive each fence member, and a notch adjacent the aperture for receiving the fixed peg, (iii) locating the tubular fence member within the aperture so that the fixed peg lies alongside the notch, and (iv) rotating the fence member about its longitudinal axis so that the peg enters the notch in the rail.

* * * * *